United States Patent [19]

Pole et al.

[11] Patent Number: 4,989,305

[45] Date of Patent: Feb. 5, 1991

[54] SUGAR CANE MILL ROLLER

[75] Inventors: Kishor M. Pole; Bhagawan S. Dhavlikar, both of Maharashtra, India

[73] Assignee: Walchandnagar Industries Limited, Bombay, India

[21] Appl. No.: 347,169

[22] Filed: May 3, 1989

[51] Int. Cl.[5] ..... B02C 4/00

[52] U.S. Cl. ..... 29/121.7

[58] Field of Search ..... 29/121.1, 121.4, 121.6, 29/121.7; 100/97, 121, 155 R, 176, 210; 99/509; 241/93, 293

[56] References Cited

U.S. PATENT DOCUMENTS

| | | | |
|---|---|---|---|
| 3,969,802 | 7/1976 | Bouvet | 100/121 X |
| 4,378,253 | 3/1983 | Bouvet | 100/121 X |
| 4,391,026 | 7/1983 | Casey et al. | 29/121.6 |
| 4,546,698 | 10/1985 | Bouvet | 29/121.4 X |
| 4,561,156 | 12/1985 | Sun | 29/121.6 |
| 4,566,165 | 1/1986 | Georget | 29/121.6 |
| 4,765,550 | 8/1988 | Chen | 241/293 |

FOREIGN PATENT DOCUMENTS

| | | |
|---|---|---|
| 2049783 | 10/1983 | Australia . |
| 156071 | 5/1985 | India . |

*Primary Examiner*—Mark Rosenbaum
*Assistant Examiner*—Frances Chin
*Attorney, Agent, or Firm*—Ladas & Parry

[57] ABSTRACT

The invention is an improved sugar can mill roller. The roller body is generally cylindrical and has peripheral V-grooves formed circumferentially on the roller body. An axial bore is formed through the length of the roller body, through which a roller shaft is mounted. The roller body further has spaced apart channels located below the V-grooves and parallel to the axial bore. The channels are open at least at one end of the roller body. Circumferentially spaced apart holes are located at the bottom of each of the V-grooves, wherein the holes pass from the bottom of the V-grooves to the nearest channel. The roller body further has circumferentially spaced apart first ports passing from one flank on each of the V-grooves to the nearest channel, and circumferentially spaced apart second ports pssing from the other flank on each of the V-grooves to the nearest channel. Each of the holes, first ports and second ports are formed with a step and have an insert positioned therein against the respective step, the inserts being provided with an axial orifice. There is also provided a vacuum system connected to the open ends of the channels for aiding in juice extraction during the rolling process.

9 Claims, 5 Drawing Sheets

FIG. 1
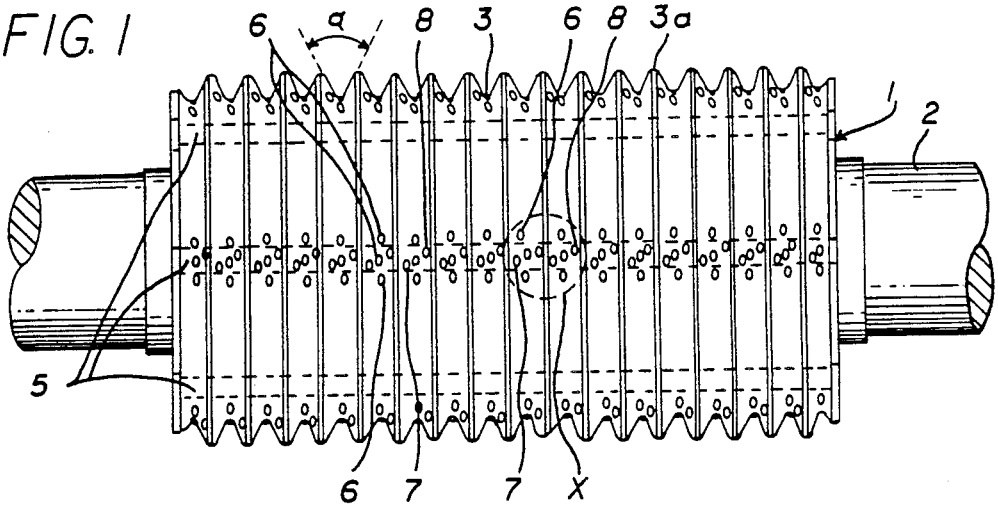
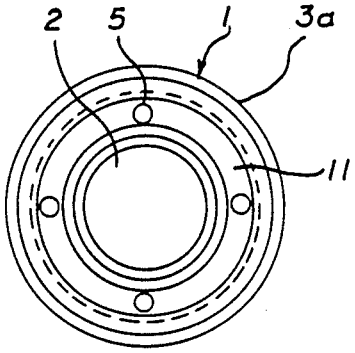
FIG. 2
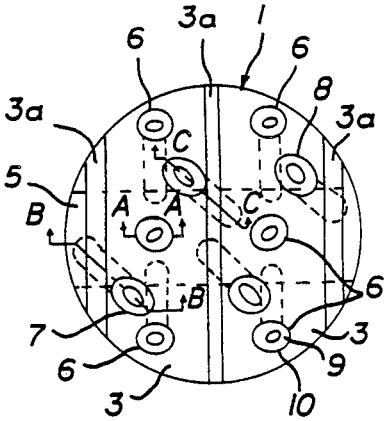
FIG. 3
FIG. 4
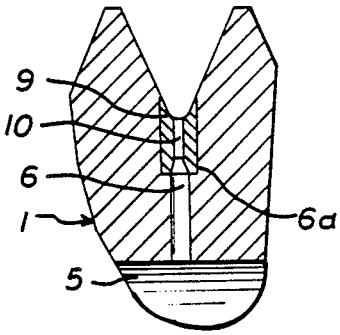
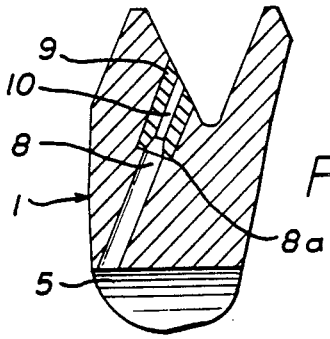
FIG. 5
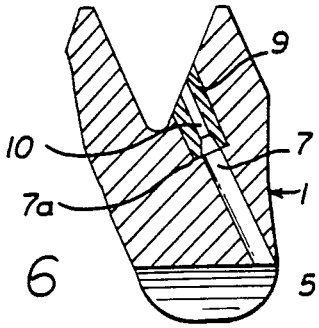
FIG. 6

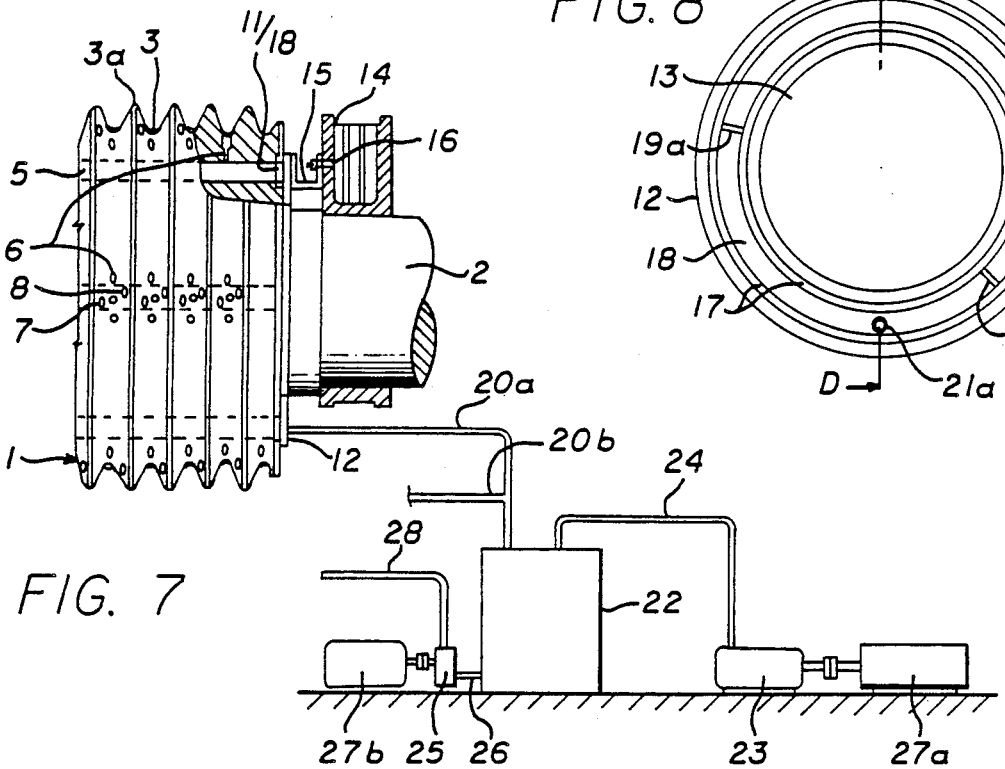
FIG. 7
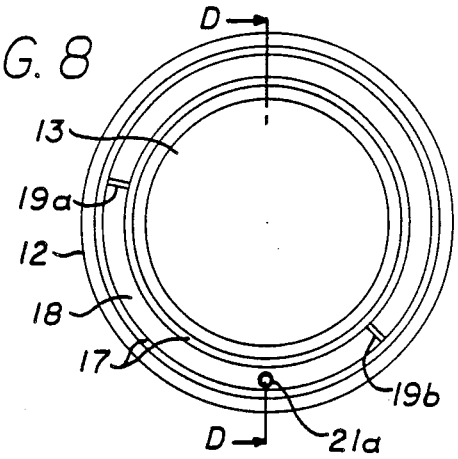
FIG. 8
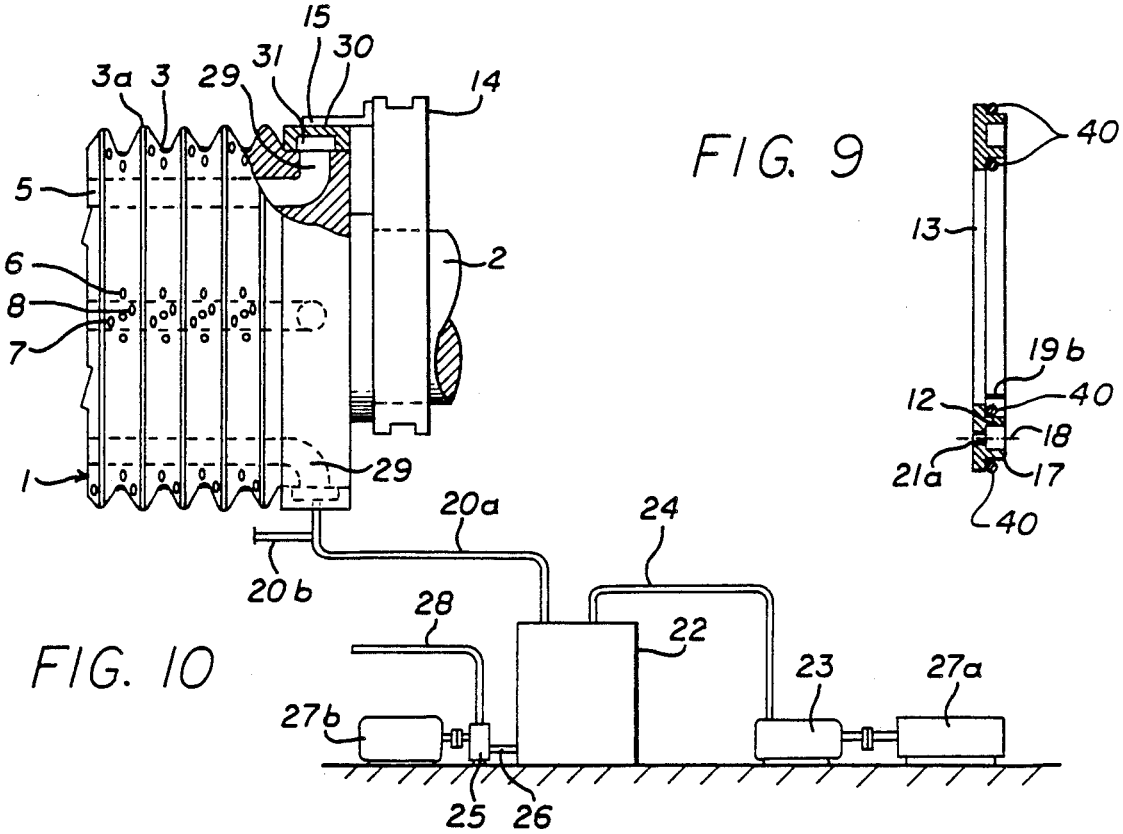
FIG. 9
FIG. 10

FIG. 12
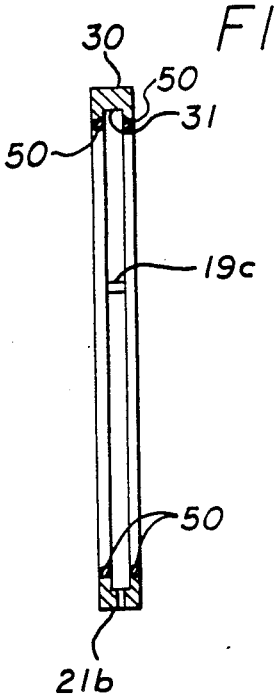
FIG. 11
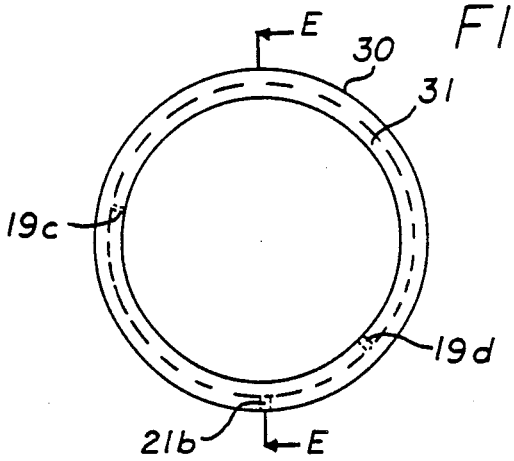
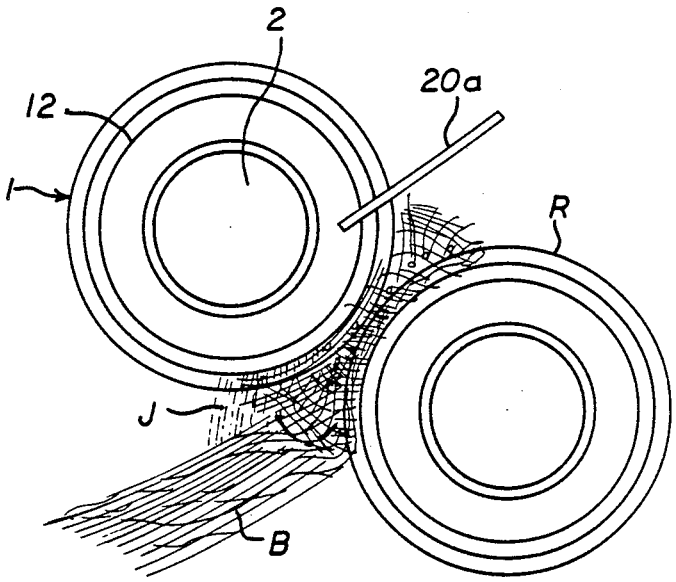
FIG. 13
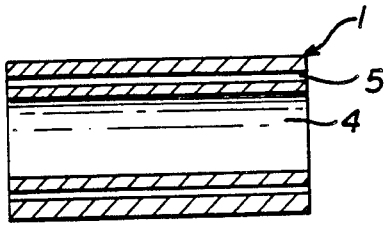
FIG 14A
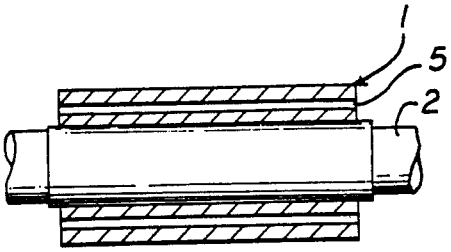
FIG. 14B

SUGAR CANE MILL ROLLER

This invention relates to improvements in or relating to a sugar cane mill roller.

In a sugar cane mill, juice is extracted from bagasse under pressure between two or more rollers. In order to increase extraction, higher pressures are required to be applied between the rollers. However, in such a mill reabsorption of extracted juice back into the blanket of bagasse passing between the rollers is a common phenomenon, and it is well known that reabsorption increases with increase in pressure and reduces extraction efficiency and crushing capacity of the mill besides increasing power consumption by the mill.

In order to minimise reabsorption and improve extraction efficiency of a sugar cane mill in U.S. Pat. No. 3,969,802 there is proposed a mill roller comprising a roller body having a plurality of peripheral grooves formed circumferentially thereon, a plurality of channels within the roller body extending axially throughout the roller body, and a plurality of holes extending substantially radially from the bottom of said grooves and communicating with said channels.

In Indian Pat. No. 156071, there is described a mill roller which is claimed to be an improvement over that of the above U.S. patent and comprises a roller body, a plurality of circumferentially extending grooves formed in the periphery of said roller body, a plurality of channels extending axially through said roller body inwardly of said grooves, and a plurality of inserts fitted within said roller body at the radial bottoms of said grooves, each said insert having extending substantially radially therethrough an opening connecting the respective said groove with a respective said channel, each said opening having an elongated, substantially rectangular circumferential crosssection with a longer dimension extending substantially circumferentially of said roller body and a narrower diamension extending axially of said roller body.

In U.S. Pat. No. 4,546,698 there is proposed a mill roller comprising a generally cylindrical rigid body, a plurality of circumferential grooves around the outer surface of said body, a plurality of juice flow channels within and around said body below said outer surface thereof and opening from at least one end thereof, said channels. being of spiral configuration extending end to end of said body through less than one turn about the axis thereof and a plurality of generally radial holes in said body forming flow ducts between said grooves and said channels.

In Australian Pat. No. 20497183, there is described a method for the manufacture of a roller of the type in which the external surface includes annular grooves of triangular crosssection, with the bottom of each groove communicating with longitudinal channels formed in the roller, said method comprises forming one or more radial ducts in a plurality of crosssectional regions of the roller so that the radial ducts opens into each of the longitudinal channels formed in the roller, inserting a plug with a blind hole drilled in it from its inner end into the or each radial duct, forming annular grooves of triangular crosssectional around the periphery of the roller with the apex of each triangle being situated in the planes of crosssection through the hole, and drilling a circular hole at the bottom of each groove to a depth sufficient to establish communication between the bottom of the groove and the corresponding blind hole.

During operation of sugar cane mills using the above mentioned rollers, part of the extracted juice falls down from along the roller surface into trays disposed below the rollers and part of the extracted juice at the bottom of the peripheral grooves also gets drained into the trays at the ends of the rollers through the radial holes/openings in the inserts/plugs at the bottom of the peripheral grooves and the channels thereby reducing reabsorption and increasing extraction efficiency of the mills. However, in sugar cane mills bagasse at the flanks of the peripheral grooves is under maximum pressure and hence juice extraction is maximum at the flanks of the peripheral grooves. Since permeability of bagasse reduces with increase in pressure, considerable quantity of the juice being extracted at the flanks of the peripheral grooves gets reabsorbed or entrapped in the blanket of bagasse passing between the rollers particularly in view of the fact that such juice has no egress thereby still creating/causing considerable reabsorption and reducing extraction efficiency and crushing capacity of the mills and increasing power consumption by the mills.

An object of the present invention is to provide an improved sugar cane mill roller whereby reabsorption can be reduced and extraction efficiency and crushing capacity can be increased and power consumption can be reduced.

Another object of the present invention is to provide a simple and economical method of manufacturing the improved sugar cane mill roller.

According to the present invention there is provided an improved sugar cane mill roller comprising a roller body having peripheral v grooves formed circumferentially thereon and an axial bore formed therethrough and mounted on a roller shaft through the axial bore thereof, said roller body further having spaced apart straight channels provided through the entire length thereof and circumferentially spaced apart holes at the bottom of each of the V grooves, said holes originating from the bottom of the V grooves and terminating in said channels, said channels being open at least at one end of said roller body, and said roller body further having circumferentially spaced apart first ports originating from one flank each of the V grooves and terminating in said channels, and circumferentially spaced apart second ports originating from the other flank each of the V grooves and terminating in said channels, each of said holes, first ports and second ports being formed with a step therein and having an insert located therein against the respective step, said insert being provided with an axial orifice.

Preferably said channels are circular.

Preferably, said roller shaft is made of steel, said roller body is made of cast iron and said insert is made of cast iron. Since the roller body and inserts are of the same material they will suffer the same wear and tear. Consequently the contact pressure of scraper plate and trash plate of the mill remains uniform thereby maintaining efficient scrapping which reduces clogging of the holes and ports. Furthermore, the inserts maintain their fit in the roller body irrespective of temperature variations due to the fact that there will not be any differential expansion.

Preferably, said axial orifice is circular and flared towards the respective channel. This particular geometry of the axial orifices will prevent clogging of the axial orifices by the bagasse particles present in the juice.

Preferably; said first port and second port are located at a point ⅓rd distance up from the bottom of the respective v groove, which point has been found to be the mean pressure point. This ensures the mechanical strength of the tooth or ridge formed by two consecutive V grooves.

According to an embodiment of the present invention said improved roller includes a vacuum system connected to the open ends of said channels.

According to an embodiment of the present invention said channels terminate in a recess provided at each end of said roller body and said vacuum system comprises a pair of end plates, each of said end plates being disposed at each end of said roller body over said roller shaft through a centre opening provided therein and mounted on the respective bearing housing, each of said end plates having a projection at the inner side thereof confronting said recess, said projection registering with and located in said recess is a liquid tight manner and having a depression formed therein, said depression being divided into two parts by a pair of transverse members such that one of said two parts always corresponds to the roller surface in contact with bagasse and free juice pool, if any, said one part being connected to a juice collection tank provided with a vacuum pump and a juice pump, each of said pumps being associated with a prime mover.

According to another embodiment of the present invention said channels terminate in radial passages provided at each end of said roller body and said vacuum system comprises a pair recessed rings, each ring being mounted on each end of said roller body such that said radial passages open into the recess of the respective ring, said recess being divided into two parts by a pair of transverse members such that one of said two parts always corresponds to the roller surface in contact with bagasse and free juice pool, if any, said one part being connected to a juice collection tank provided with a vacuum pump and a juice pump, each of said pumps being associated with a prime mover.

According to the present invention there is also provided a method of manufacturing the improved sugar cane mill roller, said method comprises:

i. drilling an axial bore and spaced apart straight channels through the entire length of the roller body and mounting the roller body on roller shaft through the axial bore thereof, said channels being open at least at one end of said roller body;

ii. dividing the roller body into circumferential groove zones peripherally longitudinally, cutting a L-shaped initial groove in each groove zone circumferentially such that one wall of said L-shaped initial groove makes an angel equal to half the angle of each groove with respect to the roller axis and bottom of said L shaped groove lies on one side of the center line of the respective groove zone, drilling circumferentially spaced apart radially inclined first ports through said one wall at right angle thereto such that said first ports terminate in said channels and are formed with a step therein, and locating an insert in each of said first ports against the respective step;

iii. further cutting the initial groove into a substantially V shaped groove such that the bottom wall of said substantially v shaped groove makes an angle equal to half the angle of each V groove with respect to the roller axis and the bottom of said substantially V shaped groove lies on the opposite side of the centre line of the respective zone, drilling circumferentially spaced apart radially inclined second ports through said bottom wall at right angle thereto such that said second ports terminate in said channels and are formed with a step therein and locating an insert in each of said second ports against the respective step;

iv. further cutting the said substantially v shaped groove into a symmetrical v groove such that the bottom wall thereof is parallel to the roller axis, drilling circumferentially spaced apart holes through the bottom wall of said symmetrical V groove such that the axis of said holes passes through the centre line of the respective groove zone and said holes terminate in said channels and are provided with a step therein, and locating an insert in each of said holes against the respective step, said holes and first ports and second ports being so staggered and distributed that the stress zones surrounding said holes and ports do not overlap and said holes and ports facilitate access to juice thereinto, the insert in each of the holes, first ports and second ports being provided with an axial orifice; and V. further cutting and shaping said symmetrical V groove into the required size V groove such that said first ports are located on one flank of the V groove, said second ports are located on the other flank of the respective V groove and said holes are located at the bottom of the respective V groove.

According to an embodiment of the present invention, said method comprises drilling circular channels through the entire length of said roller body.

According to an embodiment of the present invention, said roller body is made of cast iron and said method comprises shrunk fitting said roller body on said shaft which is made of steel and said insert is made of cast iron and said method comprises pressfitting said insert in each of said first ports, second ports and holes.

According to an embodiment of the present invention, said method comprises providing said first ports and second ports at a point ⅓rd distance up from the bottom of the respective V groove.

According to an embodiment of the present invention, said method comprises pressfitting said insert in said first ports, second ports and holes, said insert being provided with a circular orifice flared towards the respective channel.

The present invention is described hereinbelow with reference to the accompanying drawings, in which:

FIG. 1 is elevation of the improved sugar cane mill roller according to an embodiment of the present invention;

FIG. 2 is one end view of the roller of FIG. 1;

FIG. 3 is an enlarged view of the portion marked X in FIG. 1;

FIG. 4 is the section taken at A—A in FIG. 3;

FIG. 5 is the section taken at B—B in FIG. 3;

FIG. 6 is the section taken at C—C in FIG. 3; and

FIG. 7 is a partially cut away partial elevation of the roller of FIG. 1 including a vacuum system according to an embodiment of the present invention;

FIG. 8 is an inner side view of one of the end plates of the roller of FIG. 7;

FIG. 9 is a section taken at D—D in FIG. 8;

FIG. 10 is partially cut away partial elevation of the roller of FIG. 1 including a vacuum system according to another embodiment of the present invention;

FIG. 11 is an elevation view of one of the recessed rings of the roller of FIG. 10;

FIG. 12 is a section taken at E—E in FIG. 11;

FIG. 13 is partial view of a two roller sugar cane mill having the roller of FIGS. 1 to 9.

FIGS. 14A and 14B, 15A, 15B, 15C and 15D, 16A, 16B, 16C and 16D and 17A, 17B, 17C, 17D, 17E and 17F are crosssectional elevations and partial crosssectional elevations and plans of the roller of FIG. 1 at various stages of manufacture.

Figure 15A:
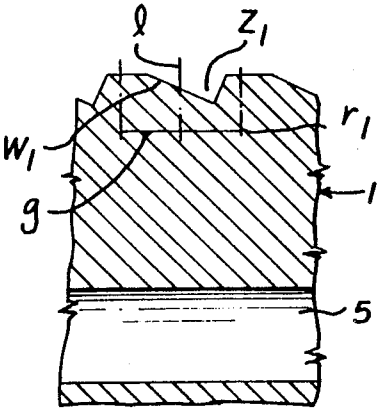

Referring to FIGS. 1 to 6, the improved roller comprises a roller body 1 mounted on roller shaft 2. Roller body 1 is having peripheral v grooves 3 formed circumferentially thereon and an axial bore 4 (see FIG. 14A) formed therethrough. The ridge or tooth formed between adjacent V grooves 3 is marked 3*a*. Roller body 1 is mounted on roller shaft 2 through the axial bore 4 thereof. V groove is marked '*a*' (see FIG. 1). Roller body 1 is further angle having spaced apart straight channels 5 provided through the entire length thereof and circumferentially spaced apart holes 6. Holes 6 originate from the bottom of the V grooves 3 and terminate in channels 5 (see FIGS. 1, 3 and 4). Each hole 6 is provided with a step marked 6*a* therein (see FIG. 4). Roller body 1 is further provided with circumferentially spaced apart first ports 7 through one flank of each of the V grooves. First ports 7 originate from said one flank each of the V grooves 3 and terminate in channels 5 (see FIGS. 1, 3 and 6). First ports 7 are formed with a step 7*a* therein (see FIG. 6). Roller body 1 is further provided with circumferentially spaced apart second ports 8 formed through the other flank each of the V grooves 3. Second ports 8 originate from said other flank each of the V grooves 3 and terminate in channels 5 (see FIGS. 1, 3 and 5). Second ports 8 are formed with a step 8*a* therein (see FIG. 5). Holes 6, first ports 7 and second ports 8 are so staggered and distributed that the stress zones surrounding them do not overlap and they facilitate access to juice thereinto thereby ensuring mechanical strength of the roller and providing quick escape routes for juice. Each of holes 6, first ports 7 and second ports 8 is having an insert 9 located therein against the respective step (see FIGS. 3, 4, 5 and 6). Insert 9 is having a circular axial orifice 10 therethrough flared towards channels 5 (see FIGS. 4, 5 and 6). During operation of a sugar cane mill having the improved roller, part of the extracted juice falls down from along the roller surface into a tray (not shown) disposed below the roller. Part of the extracted juice at the bottom of the V grooves 3 also gets drained into the tray at the ends of the roller through axial orifices 10 in inserts 9 located in holes 6 and channels 5 thereby reducing reabsorption and increasing extraction efficiency of the mill. As mentioned earlier, maximum juice extraction takes place at the flanks of the V grooves 3 of the roller. Part of the juice being extracted at the flanks of the V grooves 3 of the roller also gets simultaneously drained into the tray at the ends of the roller through axial orifices 10 in inserts 9 located in first ports 7 and second ports 8 and channels 5 thereby further reducing reabsorption and increasing juice extraction efficiency of the mill. Since reabsorption is reduced power consumption by the mill is also reduced. Further, since reabsorption is reduced, roller speed can also be increased to increase crushing capacity of the mill.

11 is a recess provided at each end of roller body 1 and channels 5 terminate in recess 11 (see FIGS. 2 and 7). 12 is an end plate provided with a centre opening 13 (see FIGS. 7, 8 and 9) and disposed at each end of roller body 1 over roller shaft 2 through centre opening 13 provided therein (see FIG. 7). Each end plate 12 is mounted on the bearing housing 14 at each end of the roller using bracket 15 and bolts 16 (See FIG. 7). Each end plate 12 is provided with a projection 17 at its inner side confronting recess 11 (See FIGS. 7, 8 and 9). Projection 17 registers with recess 11 and is located in recess 11 in close contact with tho wall of recess 11 in a liquid tight manner and is having a depression 18 formed therein (see FIGS. 7, 8 and 9). Depression 18 is divided into two parts by a pair of transverse numbers 19*a* and 19*b* (See FIGS. 8 and 9). At any given point of time during rotation of roller body 1, only a part of the surface thereof will be in contact with bagasse B and free juice pool J (see FIG. 13). In FIG. 13, the other roller is marked R. Other features/parts of the mill are not necessary for the purpose of understanding the invention and have not therefore been shown in FIG. 13. Depression 18 is so divided into two parts such that one of said two parts always corresponds to the roller body surface in contact with bagasse and free juice pool, if any. 20*a* is a flexible pipe one end of which is connected to said one part of depression 18 in one of the end plates through slot 21*a* provided therein (See FIGS. 7, 8 and 9). 20*b* (See FIG. 7) is another flexible pipe one end of which is connected to flexible pipe 20*a* and the other end of which is connected to said one part of depression 18 in the other end plate (not shown) through slot 21*a* provided therein. The other end of pipe 20*a* is connected to a juice tank 22 which in turn is connected to a vacuum pump 23 through a pipe 24 and a juice pump 25 through pipe 26. 27*a* and 27*b* represent prime movers such as electric motors associated with pumps 23 and 25, respectively. 28 is the discharge end of pump 25. During operation of sugar cane mill having the improved roller, vacuum is continuously applied in channels 5 and orifices 10 in inserts 9 located in holes 6 and ports 7 and 8 by vacuum pump 23. Consequently extracted juice both at the bottom and flanks of the V grooves 3 will drain into tank 22 faster thereby still further reducing reabsorption and increasing extraction efficiency of the mill. Under vacuum chances of orifices 10 and channels 5 getting clogged are minimised facilitating smooth and quick flow of juice therethrough. Since reabsorption is further reduced power consumption by the mill is also correspondingly reduced. Since reabsorption is further reduced roller speed can also be correspondingly increased to increase crushing capacity of the mill. The amount of vacuum applied will depend upon parameters such as the size and/or capacity of the mill and will have to be selected. Usually the vacuum applied may be of the order of 500 mm of mercury. Preferably end plates 12 are made of mild steel and if required an O-ring 40 may be provided between projection 17 and abutting wall to recess 11 to prevent leakage of vacuum between projection 17 and the wall of recess 11.

End plates 12 can be dismantled from bearing housing 14 by unscrewing bolts 16. The vacuum system can thus be disconnected from roller body 1 if and when not required.

The roller of FIGS. 10 to 12 is similar to and functions in the same manner as that of FIGS. 1 to 9 except for the following differences.

Channels 5 terminate in radial passages 29 provided at each end of roller body 1 (see FIG. 10). 30 is a recessed ring mounted on each end of roller body 1 such that radial passages 29 open into recesses 31 in rings 30. Each of rings 30 is divided into two parts by a pair of transverse members 19*c* and 19*d* such that one of said two parts always corresponds to the rollerbody surface in contact with bagasse and free juice pool, said one part being connected to tank 22 through a slot 21*b* provided through the outer wall of each of rings 30 and via pipes 20*a* and 20*b*. Preferably rings 30 are made of mild steel and if required O-rings 50 may be provided between the edges of rings 30 and abutting roller body surface to prevent leakage of vacuum between the edges of rings 30 and abutting roller body surface.

Preferably end plates 12 and recessed rings 30 are of two piece construction to facilitate fitting and removal thereof.

Instead of connecting said one part of both the end plates or recessed rings to the same tank 22, it is possible to connect said one part of each of the end plates or recessed rings to separate tanks 22. In case channels 5 are open at only one end of the roller body, obviously only one end plate or recessed ring will be required. Such variations are within the scope of the present invention and the scope of the present invention should be construed accordingly.

Figure 15B:
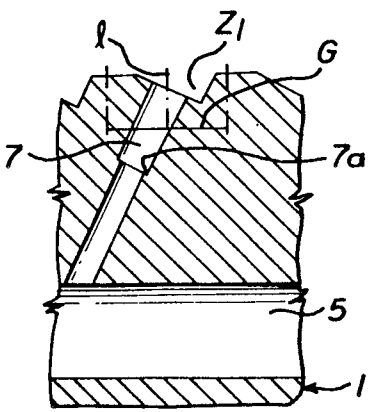
Figure 15C:
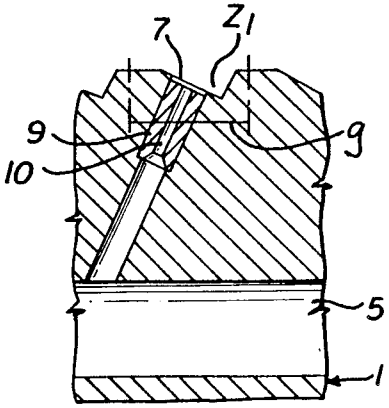
Figure 15D:
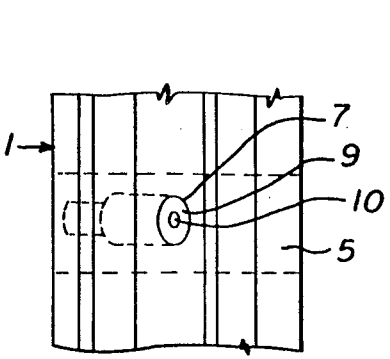
Figure 16A:
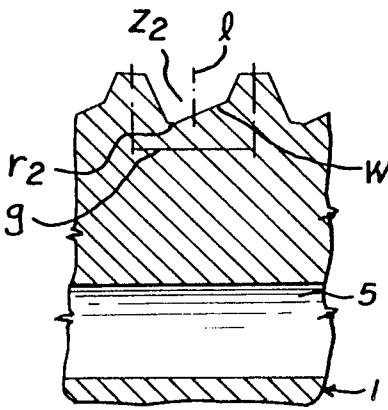
Figure 16B:
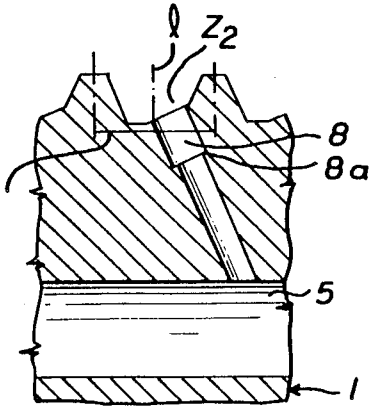
Figure 16C:
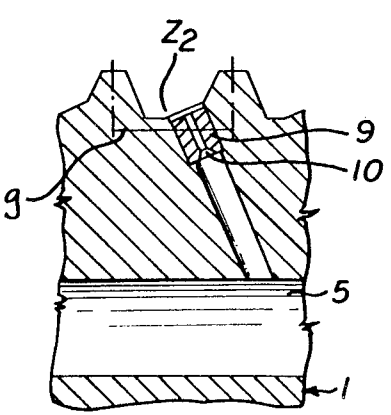
Figure 16D:
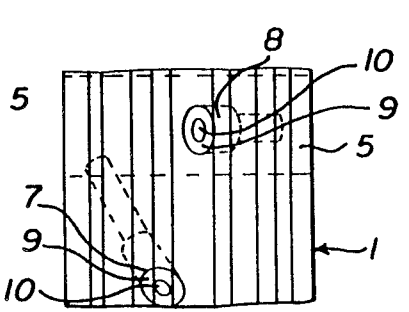
Figure 17D:
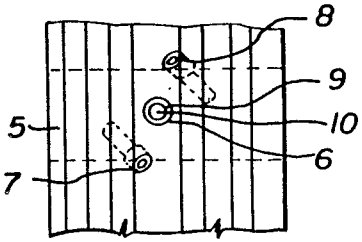
Figure 17C:
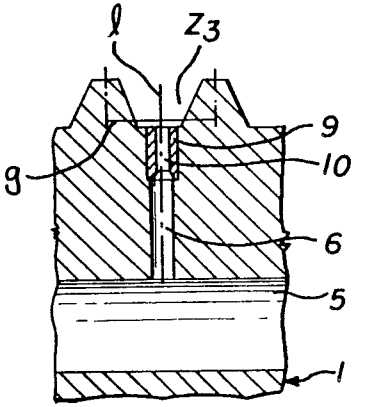
Figure 17F:
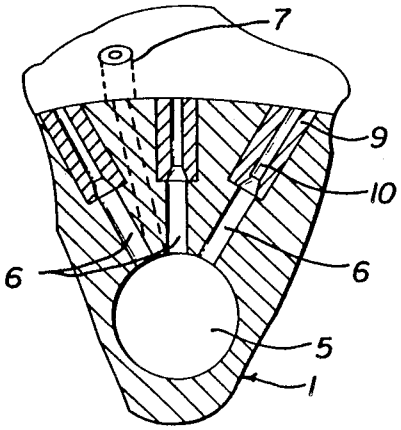
Figure 17B:
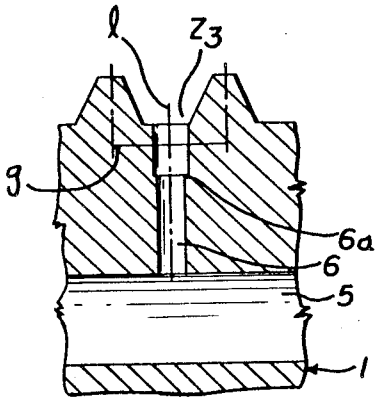
Figure 17E:
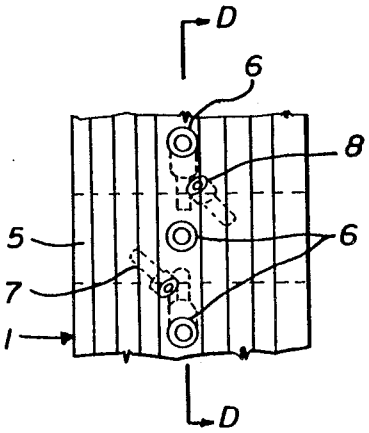
Figure 17A:
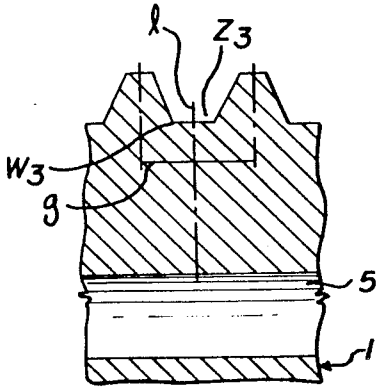

The improved roller of FIG. 1 may be manufactured by the following method which comprises:

i. drilling an axial bore 4 and spaced apart straight channels 5 through the entire length of the roller body 1(see FIG. 14A) and mounting the roller body on a roller shaft 2 through the axial bore thereof (see FIG. 14B);

ii. dividing the roller body into circumferential groove zones 'g ' peripherally longitudinally a L-shaped initial groove '$z_l$' in each groove zone circumferentially such that one wall marked '$w_l$' of L-shaped initial groove '$z_1$' makes an angle equal to half the angle 'a' of the respective V groove with respect to the roller axis and bottom '$r_1$' of L-shaped initial groove '$z_1$' lies on one side of the centre line '1' of the respective groove zone (see FIGS. 1 and 15A), drilling circumferentially spaced apart radially inclined first ports 7 through said one wall '$w_l$' at right angle thereto such that said first ports 7 terminate in said channels 5 and are formed with a step 7*a* therein (see FIG. 15B) and locating an insert 9 in each of said first ports against the respective step (see FIGS. 15C and 15D which is plan of FIG. 15C);

iii further cutting the L-shaped initial groove '$z_l$' into a substantially V shaped groove $z_2$ such that the bottom wall '$w_3$' of groove '$z_2$' makes an angle equal to half the angle 'a' of the respective V groove with respect to the roller axis and bottom '$r_2$' of groove '$z_2$' lies on the opposite side of the centre line '1' of the respective groove zone (see FIGS. 1 and 16A), drilling circumferentially spaced apart radially inclined second ports 8 through said bottom wall '$w_2$' at right angle thereto such that said second ports 8 terminate in said channels 5 and are formed with a step 8*a* therein (see FIG. 16B) and locating an insert 9 in each of said second ports against the respective steps (see FIGS. 16C and 16D which is plan of FIG. 16C).

iv. further cutting the said substantially V shaped groove into a symmetrical V groove '$z_3$' such that the bottom wall '$w_3$' *thereof is parallel to the roller axis (see FIG. 17A), drilling circumferentially spaced apart holes 6 through the bottom wall '$w_3$'* of said symmetrical V groove '$z_3$' such that the axis of holes 6 passes through the centre line '1' of the respective groove zone 'g' and said holes 6 terminate in said channels 5 and are provided with a step 6*a* therein (see FIG. 17B) and locating an insert 9 in each of the holes 6 against the respective step (see FIGS. 17C, 17D, 17E and 17F). FIG. 17D is plan of FIG. 17C. FIG. 17E is partial plan of the roller after three holes 6 have been drilled and inserts 9 have been located therein. FIG. 17F is a section at D—D in FIG. 17E), said holes, first ports and second ports being so staggered and distributed that the stress zones surrounding said holes and ports do not overlap and said holes and ports facilitate access to juice thereinto, the insert in each of the holes, first ports and second ports being provided with an axial orifice 10(see FIGS. 15C, 15D, 16C, 16D, 17C, 17D, 17E and 17F; and v. further cutting and shaping the said symmetrical v groove 'z' into the required size V groove such that said first ports are located on one flank of the V groove, said second ports are located on the other flank of the respective V groove and said holes located at the bottom of the respective V groove (see FIGS. 1, 3, 4, 5 and 6).

Inconsequential variations in the sequence of the above steps of the method are possible. For instance, division of the roller body 1 into circumferential groove zones g peripherally longitudinally can also be carried out prior to mounting the roller body 1 on roller shaft 2. Such variations are within the scope of the method and the scope of the present invention should be construed accordingly.

The above method is quite simple and easy to carry out and economical.

The above embodiments are, by way of example, and should not be construed to be limitative of the scope of the present invention.

We claim:

1. An improved sugar cane mill roller for extracting sugar cane juice from sugar cane and bagasse comprising:

a generally cylindrical roller body having a first end and a second end located opposite of said first end, said roller body defining peripheral V-grooves therein, said V-grooves having a first and second flank joined at a bottom, and being formed circumferentially around said roller body and forming a roller surface;

a roller shaft;

an axial bore formed through said roller body, said roller body mounted on said roller shaft;

a plurality of channels defined in said roller body, said channels having two ends and positioned in a spaced apart relationship lying below said roller surface and substantially parallel to said axial bore of said roller body, said channels being open at least at one end;

circumferentially spaced apart holes defined in the bottom of each of the V-grooves, said holes extending from the bottom of the V-grooves to a channel nearest said holes;

circumferentially spaced apart first ports defined in said first flank of each of the V-grooves and extending to a channel nearest said first ports;

circumferentially spaced apart second ports defined in said second flank of each of the V-grooves and extending to a channel nearest said second ports, each of said holes, first ports and second ports being formed with a step therein and having an insert located against each respective step, said inserts being provided with an axial orifice; and a vacuum system connected to said at least one open end of said channels.

2. The improved sugar cane roller of claim 1, further comprising:

an annular recess defined in said first end and said second end of said roller body and having a bottom and side walls, wherein said channels extend from the annular recess at said first end to the annular recess at said second end;

a pair of generally circular end plates having an inner side and an outer side, said end plates being provided with an opening in their centers, said opening being of slightly larger circumference than the circumference of said roller shaft, one each of said end plates being disposed at said first end and said second end of said roller body, said roller shaft passing through said opening provided in said end plates;

a bearing housing mounted to each end plate and rotatable around said roller shaft; and wherein said vacucum system further comprises a juice collection tank provided with a vacuum pump and a juice pump and a means to activate each of said pumps and an annular projection having an outermost portion, said annular projection formed on the inner side of each of said end plates, said outermost portion of said projections having an annular depression formed therein, said depression being divided into a first and second part by a pair of transverse members passing through the end plates, said first part having an aperture therein, wherein said annular projections confront and register with said recesses in a liquid tight manner, and wherein said apertures in said first part allow communication with the channels communicating with said holes, first ports and second ports defined in those portions of the V-grooves of the roller surface in contact with bagasse and any present free juice pool and allow communication with said juice collection tank connected to the apertures by piping, and thereby cause any present free juice in the vicinity of those holes, first ports and second ports communicating with said collection tank to be transported to said juice collection tank.

3. The improved roller as claimed in claim 2, wherein said end plates are made of mild steel.

4. The improved roller as claimed in claim 2 wherein said end plates are of two piece construction.

5. The improved roller as claimed in claim 2, wherein O-rings are provided between the projection of each of said end plates and said side walls of said recess.

6. The improved roller as claimed in claim 1, wherein said roller surface has ungrooved portions near said first and second ends of said roller body, said channels terminating in a radial passage joining with said ungrooved portions of said roller surface near said first and second ends of said roller body; and wherein said vacuum system further comprises:

a juice collection tank provided with a vacuum pump and a juice pump and a means to activate each of said pumps; and a pair of rings having a recess on their inner edges which are adjacent to the ungrooved portions of said roller surface, said recesses being divided into a first and a second part by a pair of transverse members, said first parts having an aperture, wherein each ring is mounted one each on the ungrooved roller surface portions at each end of said roller body such that said radial passages open into the recess of each ring, and wherein said apertures in said first parts allow communication with the channels communicating with said holes, first ports and second ports defined in those portions of the V-groove of the roller surface in contact with bagasses and any present free juice pool and allow communication with a juice collection tank connected to the apertures by piping, and thereby cause any present free juice in the vicinity of those holes, first ports and second ports communicating with said collection tank to be transported to said juice collection tank.

7. The improved roller as claimed in claim 6, wherein said recessed rings are made of mild steel.

8. The improved roller as claimed in claim 6, wherein said recessed rings are of two piece construction.

9. The improved roller claimed in claim 6 wherein O-rings are provided between the edges of said recessed rings and abutting roller surface.

* * * * *